US010119294B2

(12) United States Patent
Camacho Cardenas

(10) Patent No.: US 10,119,294 B2
(45) Date of Patent: Nov. 6, 2018

(54) SHORT STROKE MAST-RAISING SYSTEM

(71) Applicant: Schlumberger Technology Corporation, Sugar Land, TX (US)

(72) Inventor: Alejandro Camacho Cardenas, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/476,449

(22) Filed: Mar. 31, 2017

(65) Prior Publication Data

US 2018/0283034 A1 Oct. 4, 2018

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04H 12/34*** | (2006.01) |
| ***E21B 15/00*** | (2006.01) |

(52) U.S. Cl.
CPC ..... *E04H 12/345* (2013.01); *E21B 15/00* (2013.01)

(58) Field of Classification Search
CPC ..... E04H 12/345; E21B 15/00; E21B 15/003
USPC ..... 52/745.17
See application file for complete search history.

(56) References Cited

U.S. PATENT DOCUMENTS 3,715,852 A * 2/1973 Koga ..... E04H 12/345 29/469
3,922,825 A * 12/1975 Eddy ..... E21B 15/00 173/151
3,942,593 A * 3/1976 Reeve, Jr. ..... E21B 7/023 173/151
4,269,395 A * 5/1981 Newman ..... E21B 7/023 173/147
4,616,454 A * 10/1986 Ballachey ..... E21B 7/02 52/115
4,759,414 A * 7/1988 Willis ..... E21B 15/00 173/185
9,745,771 B2 * 8/2017 Campbell ..... E04H 12/347
2003/0159854 A1 * 8/2003 Simpson ..... E21B 15/003 175/52
2009/0320385 A1 * 12/2009 Stoetzer ..... E02D 7/00 52/118
2013/0180186 A1 * 7/2013 Konduc ..... E21B 15/00 52/119
2015/0308140 A1 * 10/2015 Clifton ..... F03D 9/007 248/346.2
2016/0060893 A1 * 3/2016 Roodenburg ..... E21B 7/02 52/123.1
2016/0312543 A1 * 10/2016 Cheng ..... E21B 15/00
2016/0376808 A1 * 12/2016 Magnuson ..... E21B 19/12 52/123.1
2017/0096832 A1 * 4/2017 Robb ..... E04H 12/345

* cited by examiner

*Primary Examiner* — Brian D Mattei
(74) *Attorney, Agent, or Firm* — Rachel E. Greene

(57) ABSTRACT

A system for raising a mast includes a primary cylinder and an actuator. The primary cylinder has a first end coupled to the mast and a second end coupled to a lifting base. The primary cylinder actuates from a retracted position to an extended position to at least partially raise the mast. The actuator actuates from a retracted position to an extended position to at least partially raise the mast, thereby moving the first end of the primary cylinder or the second end of the primary cylinder toward a pivot point between the mast and the lifting base.

16 Claims, 6 Drawing Sheets

SHORT STROKE MAST-RAISING SYSTEM

BACKGROUND

A drilling rig includes a mast to support a crown block, travelling block (and, e.g., a top drive) and, ultimately, a drill string. In some drilling rigs, during rig-up, the mast may be raised from a substantially horizontal position to a substantially vertical position. In these drilling rigs, the mast is raised using two three-stage (also called three-phase) telescopic cylinders. A first end of each cylinder is coupled to a fixed location on the mast, and a second end of each cylinder is coupled to a fixed location on the lifting base. To raise the mast, the cylinders telescopically extend in sequence proceeding from the largest portion of each cylinder to the smallest portion of each cylinder.

The cylinders are long (e.g., up to 60 feet or about 20 m) and generate large forces (e.g., 800+ klbs or about 363 Mg). Due to their relatively small diameter in relation to their length and the forces to which they are subjected, the bending forces applied to the cylinders may lead to leakages, cylinder failure, and ultimately mast collapse.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for raising a mast is disclosed. The system includes a primary cylinder and an actuator. The primary cylinder has a first end coupled to the mast and a second end coupled to a lifting base. The primary cylinder actuates from a retracted position to an extended position to at least partially raise the mast. The actuator actuates from a retracted position to an extended position to at least partially raise the mast, thereby moving the first end of the primary cylinder or the second end of the primary cylinder toward a pivot point between the mast and the lifting base.

In another embodiment, the system includes first and second primary cylinders that are substantially parallel to one another. The first and second primary cylinders each have a first end coupled to the mast and a second end coupled to a lifting base. The first and second primary cylinders each actuate from a retracted position to an extended position. The system also includes first and second upper secondary cylinders that are substantially parallel to one another. The first and second upper secondary cylinders each have a first end that is in a fixed position with respect to the mast and a second end that pushes the first ends of the first and second primary cylinders, respectively, toward a pivot point between the mast and the lifting base when the first and second upper secondary cylinders actuate from a retracted position to an extended position. The system further includes first and second lower secondary cylinders that are substantially parallel to one another. The first and second lower secondary cylinders each have a first end that is in a fixed position with respect to the lifting base and a second end that pushes the second ends of the first and second primary cylinders, respectively, toward the pivot point when the first and second lower secondary cylinders actuate from a retracted position to an extended position.

A method for raising a mast is also disclosed. The method includes actuating a primary cylinder from a first position to a second position to at least partially raise the mast. The primary cylinder includes a first end coupled to the mast and a second end coupled to a lifting base. The method also includes actuating an actuator from a first position to a second position, which causes the first end of the primary cylinder or the second end of the primary cylinder to move toward a pivot point between the mast and the lifting base.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

Figure 1:
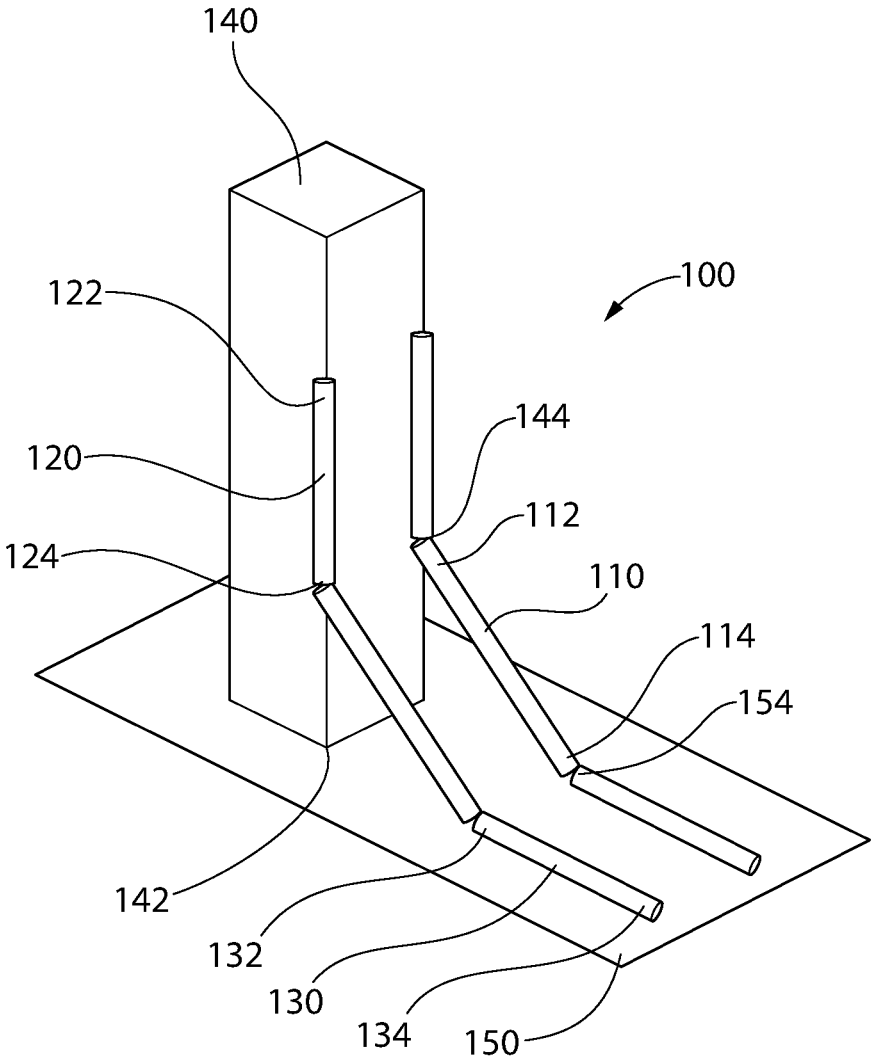
FIG. 1 illustrates a perspective, schematic view of a system for raising a mast, according to an embodiment.

FIG. 1 illustrates a perspective, schematic view of a system 100 for raising a mast 140, according to an embodiment. The system 100 may be configured to raise the mast 140 from a first, substantially horizontal position to a second, substantially vertical position about a pivot point 142. The system 100 may include one or more primary cylinders (two are shown: 110). The primary cylinders 110 may be, to name two examples, single-stage cylinders or two-stage cylinders. Conventional cylinders are most often three-stage cylinders. The primary cylinders 110 may be substantially parallel to one another. A first (e.g., upper) end 112 of each primary cylinder 110 may be coupled to the mast 140 at a mast coupling location 144, and a second (e.g., lower) end 114 of each primary cylinder 110 may be coupled to a lifting base 150 at a lifting base coupling location 154. As described in greater detail below, the mast coupling location 144 may be configured to move (e.g., slide) with respect to the mast 140, and/or the lifting base coupling location 154 may be configured to move (e.g., slide) with respect to the lifting base 150. The mast coupling location 144 and/or the lifting base coupling location 154 may slide using wheels, gears, slider pads, simple slots, etc. They may also have mechanisms to lock them into position (e.g., manually, remotely, and/or automatically) once they reach the desired position. The primary cylinders 110 may be configured to actuate between a retracted position and an extended position to vary the length of the primary cylinders 110, which may be used to at least partially raise and/or lower the mast 140. More particularly, the length may increase as the primary cylinders 110 actuate from the retracted position to the extended position.

The system 100 may also include one or more first actuators (two are shown: 120). The first actuators 120 may be or include upper secondary cylinders, and are referred to as such with respect to FIGS. 1, 3, and 7. The upper secondary cylinders 120 may be single-stage cylinders or two-stage cylinders, for example. The upper secondary cylinders 120 may be substantially parallel to one another and/or parallel to the mast 140. A first (e.g., upper) end 122 of each upper secondary cylinder 120 may be coupled to the mast 140 and/or positioned at a fixed location on the mast 140, and a second (e.g., lower) end 124 of each upper secondary cylinder 120 may be coupled to the mast 140 and/or the first (e.g., upper) end 112 of the corresponding primary cylinder 110 at the mast coupling location 144. The upper secondary cylinders 120 may be configured to actuate between a retracted position and an extended position to vary the length of the upper secondary cylinders 120 to at least partially raise and/or lower the mast 140. More particularly, the length may increase as the upper secondary cylinders 120 actuate from the retracted position to the extended position.

The system 100 may also include one or more second actuators (two are shown: 130). The second actuators 130 may be or include lower secondary cylinders and are referred to as such with respect to FIGS. 1, 3, and 7. In some embodiments, the lower secondary cylinders 130 may be single-stage cylinders or two-stage cylinders. The lower secondary cylinders 130 may be substantially parallel to one another and/or parallel to the lifting base 150. A first (e.g., distal) end 132 of each lower secondary cylinder 130 may be coupled to the lifting base 150 and/or positioned at a fixed location on the lifting base 150, and a second (e.g., proximal) end 134 of each lower secondary cylinder 130 may be coupled to the second (e.g., lower) end 114 of the corresponding primary cylinder 110 at the lifting base coupling location 154. The lower secondary cylinders 130 may be configured to actuate between a retracted position and an extended position to vary the length of the lower secondary cylinders 130 to at least partially raise and/or lower the mast 140. More particularly, the length may increase as the lower secondary cylinders 130 actuate from the retracted position to the extended position.

Figure 2:
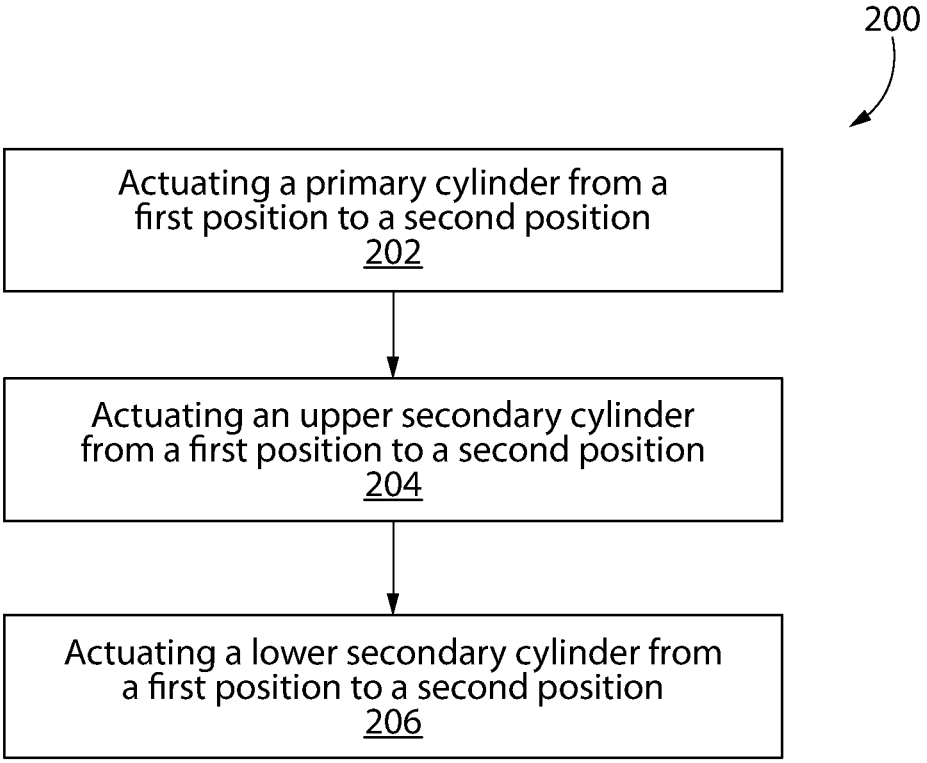
FIG. 2 illustrates a flowchart of a method for raising the mast, according to an embodiment.
Figures 3A, 3B, 3C:
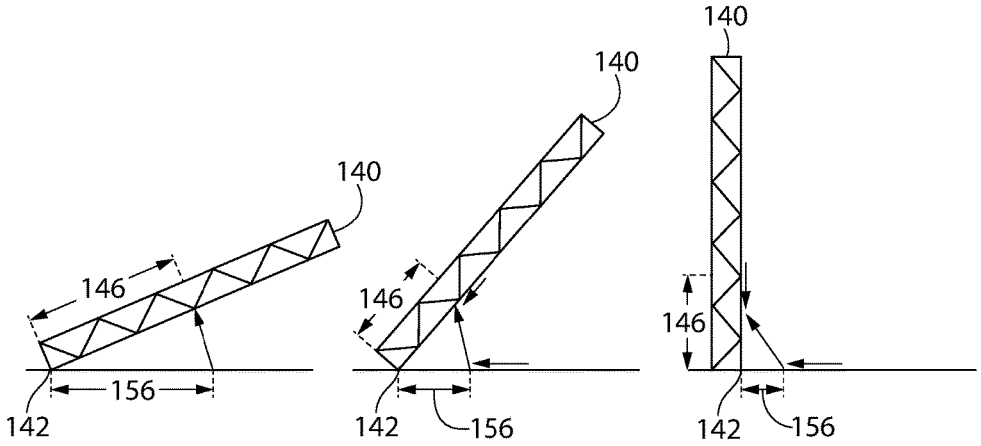
FIGS. 3A-3C illustrate side, schematic views of the system raising the mast, according to an embodiment.

FIG. 2 illustrates a flowchart of a method 200 for raising the mast 140 using the system 100, according to an embodiment. The mast 140 may initially be in the first, substantially horizontal position on the lifting base 150 (i.e., an angle between the mast 140 and lifting base 150 is about 0°). The method 200 may include actuating the primary cylinders 110 from the retracted position to the extended position, as at 202. This increases the length of the primary cylinders 110, as shown in FIG. 3A. As the primary cylinders 110 extend, the angle between the mast 140 and the lifting base 150 may increase to between about 10° and about 45° or about 15° to about 30°. The mast coupling location 144 may remain substantially constant with respect to the mast 140 as the primary cylinders 110 extend. In other words, a length 146 between the pivot point 142 and the mast coupling location 144 may remain substantially constant as the primary cylinders 110 extend.

The method 200 may also include actuating the upper secondary cylinders 120 from the retracted position to the extended position, as at 204. This may increase the length of the upper secondary cylinders 120. FIG. 3B shows the upper secondary cylinders 120 partially extended (e.g., between the retracted position and the extended position), and FIG. 3C shows the upper secondary cylinders 120 fully extended (e.g., in the extended position). The upper secondary cylinders 120 may be actuated simultaneously with the primary cylinders 110 or after the primary cylinders 110 have partially or fully extended.

As the upper secondary cylinders 120 extend, the upper secondary cylinders 120 may push the mast coupling location 144 (i.e., the upper ends 112 of the primary cylinders 110 and/or the lower ends 124 of the upper secondary cylinders 120) downward toward the pivot point 142. The pushing may be in a direction parallel with a central longitudinal axis of the mast 140. As a result, the length 146 between the pivot point 142 and the mast coupling location 144 may decrease as the upper secondary cylinders 120 extend.

The method 200 may also include actuating the lower secondary cylinders 130 from the retracted position to the extended position, as at 206. This may increase the length of the lower secondary cylinders 130. FIG. 3B shows the lower secondary cylinders 130 partially extended (e.g., between the retracted position and the extended position), and FIG. 3C shows the lower secondary cylinders 130 fully extended (e.g., in the extended position). The lower secondary cylinders 130 may be actuated simultaneously with the primary cylinders 110 or after the primary cylinders 110 have partially or fully extended. The lower secondary cylinders 130 may be actuated before, simultaneously with, or after the upper secondary cylinders 120. The upper and lower secondary cylinders 120, 130 may also be actuated 1) simultaneously+continuously throughout their movement range, 2) in alternating steps (e.g., the upper secondary cylinders 120 move a predetermined distance and stop, the lower secondary cylinders 130 move a predetermined distance and stop, the upper secondary cylinders 120 move a predetermined distance and stop, etc.) until they reach the desired position. As mentioned above, the upper and lower secondary cylinders 120, 130 may also be operated concurrently or alternatively with the primary cylinders 110.

As the lower secondary cylinders 130 extend, the lower secondary cylinders 130 may push the lifting base coupling location 154 (i.e., the lower ends 114 of the primary cylinders 110 and/or the proximal ends 134 of the lower secondary cylinders 130) toward the pivot point 142. As a result, a length 156 between the pivot point 142 and the lifting base coupling location 154 may decrease as the lower secondary cylinders 130 extend. When the primary cylinders 110, the upper secondary cylinders 120, and the lower secondary cylinders 130 are in their respective extended positions, the angle between the mast 140 and the lifting base 150 may be substantially 90°.

Figure 4:
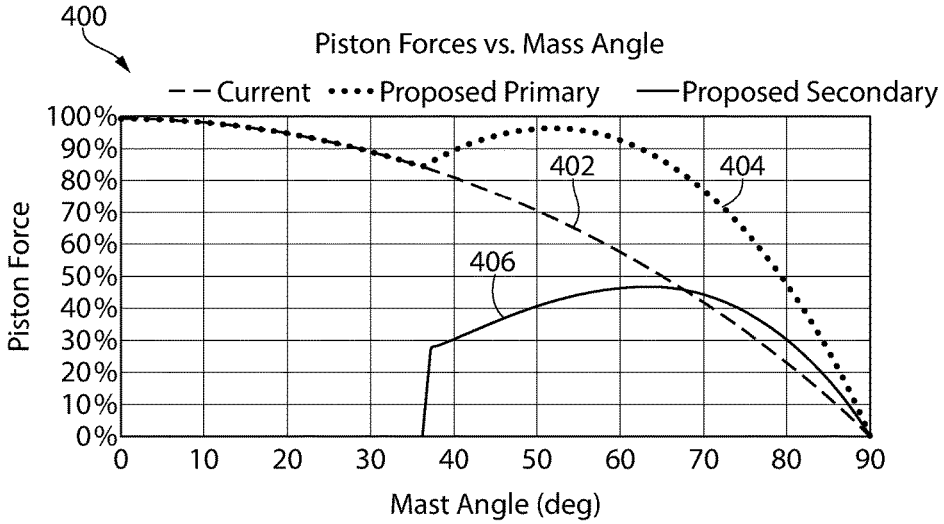
FIG. 4 illustrates a graph showing piston force vs. mast angle, according to an embodiment.

FIG. 4 illustrates a graph 400 showing piston forces vs. mast angle, according to an embodiment. Generally, the cylinders have internal pressure that pushes a piston. The piston can be another cylinder in the case of multi-stage cylinders. By convention, the part that moves inside the cylinder is called the piston, which is the element that transmits the force. The graph 400 shows the piston force (e.g., with 100% representing the highest force) against the angle of the mast 140 (with 90° being vertical). The curve 402 represents conventional cylinders. As shown, the force on the conventional cylinders starts at 100% when the mast 140 is horizontal, and the force decreases to 0% as the mast 140 proceeds to vertical.

The curve 404 represents the primary cylinders 110. As shown, the force on the primary cylinders 110 starts at 100% when the mast 140 is horizontal, and the force begins decreasing until the secondary cylinders 120, 130 begin actuating (e.g., at about 36° in this example). At this point, the force on the primary cylinders 110 begins increasing again (e.g., until the mast 140 is at about) 53°) but does not exceed the initial maximum force (e.g., 100%). The force on the primary cylinders 110 then decreases to 0% as the mast 140 proceeds to vertical. The curve 406 represents the secondary cylinders 120 and/or 130. The force on the secondary cylinders 120, 130 does not exceed 50% of the maximum force on the primary cylinders 110.

Figure 5:
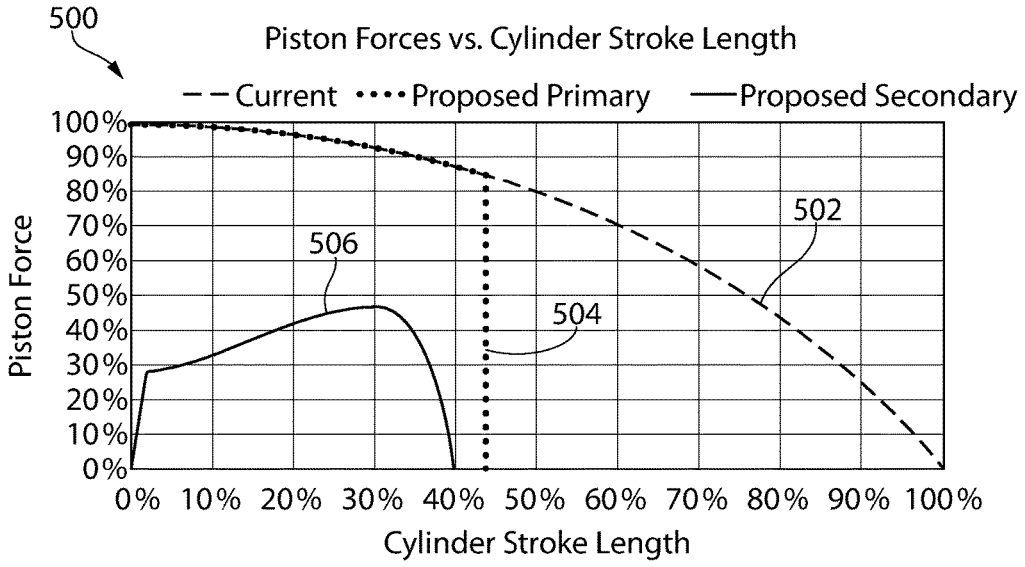
FIG. 5 illustrates a graph showing piston force vs. cylinder stroke length, according to an embodiment.

FIG. 5 illustrates a graph 500 showing piston force vs. cylinder stroke length, according to an embodiment. The curve 502 represents the conventional cylinders. As shown, the force on the conventional cylinders starts at 100% when the stroke length is 0%, and the force decreases to 0% when the stroke length is 100% (e.g., 60 feet).

The curve 504 represents the primary cylinders 110. As shown, the force on the primary cylinders 110 starts at 100% when the stroke length is 0%, and the force is substantially the same as the force on the conventional cylinder until the primary cylinders 110 are in their extended position, at which point, the force on the primary cylinders 110 drops to 0%. The stroke length of the primary cylinders 110 in the extended position may be from about 30% to about 60% or about 40% to about 50% of the stroke length of the conventional cylinders in the extended position. In the example shown in the graph 500, the stroke length of the primary cylinders 110 in the extended position is about 44% (e.g., 26.4 feet) of the stroke length of the conventional cylinders in the extended position.

The curve 506 represents the secondary cylinders 120 and/or 130. The force on the secondary cylinders 120, 130 does not exceed 50% of the maximum force on the primary cylinders 110 (in this example). In addition, the stroke length of the secondary cylinders 120, 130 in the extended position may be from about 30% to about 60% or about 40% to about 50% of the stroke length of the conventional cylinders in the extended position. In the example shown in the graph 500, the stroke length of the secondary cylinders 120, 130 in the extended position is about 40% (e.g., 24 feet) of the stroke length of the conventional cylinders in the extended position. The stroke length of the secondary cylinders 120, 130 in the extended position may be greater than, equal to, or less than the stroke length of the primary cylinders 110 in the extended position.

Figure 6:
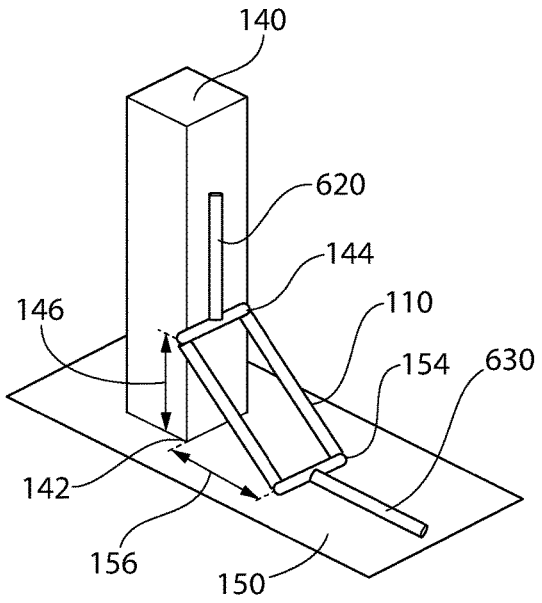
FIG. 6 illustrates a perspective, schematic view of another system for raising the mast including shared secondary cylinders, according to an embodiment.

FIG. 6 illustrates a perspective, schematic view of another system 600 for raising the mast 140, according to an embodiment. The system 600 may be similar to the system 100, except that the first actuators (e.g., upper secondary cylinders) 120 may be replaced by a single upper secondary cylinder 620, and the second actuators (e.g., lower secondary cylinders) 130 may be replaced by a single lower secondary cylinder 630.

Figure 7:
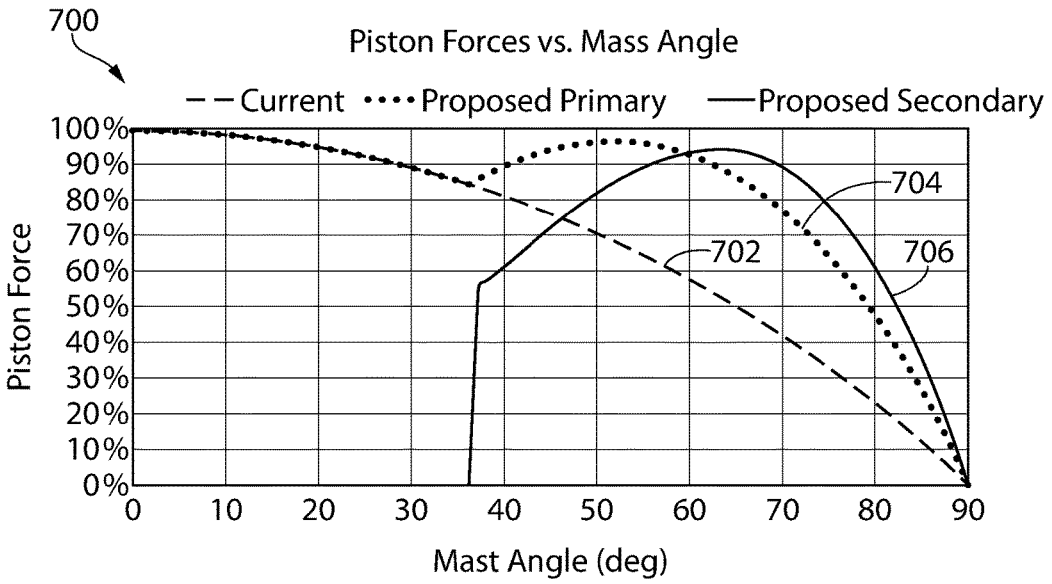
FIG. 7 illustrates a graph showing piston forces vs. mast angle, according to an embodiment.

FIG. 7 illustrates a graph 700 showing piston forces vs. mast angle for the system 600, according to an embodiment. The curves 702 and 704 may be substantially identical to the curves 402 and 404 in FIG. 4. The curve 706 represents the secondary cylinders 620, 630. When the system 600 includes a single upper secondary cylinder 620 and a single lower secondary cylinder 630, the force on the upper and/or lower secondary cylinders 620, 630 is substantially doubled. Thus, in this example, it may increase from about 48% of the maximum force (in FIG. 4) to about 96% of the maximum force (in FIG. 7).

Figure 8:
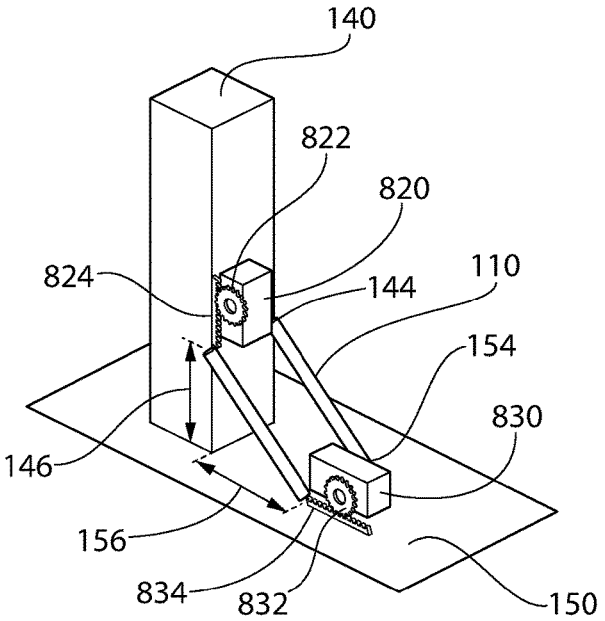
FIG. 8 illustrates a perspective, schematic view of another system for raising the mast including wheels in place of the secondary cylinders, according to an embodiment.

FIG. 8 illustrates a perspective, schematic view of another system 800 for raising the mast 140, according to an embodiment. The system 800 may be similar to the system 100, except that the first and second actuators may be or include upper and lower motors and/or gearboxes 820, 830. Each motor and/or gearbox 820, 830 may be configured to actuate a gear (e.g., a wheel) 822, 832. The upper motor and/or gearbox 820 may be configured to move an upper gear 822 toward the pivot point 142 as the mast 140 is being raised, thereby reducing the length 146 between the pivot point 142 and the mast coupling location 144. The upper gear 822 may move along a track 824 that is coupled to and/or parallel with the mast 140.

Similarly, the lower motor and/or gearbox 830 may be configured to move a lower gear 832 toward the pivot point 142 as the mast 140 is being raised, thereby reducing the length 156 between the pivot point 142 and the lifting base coupling location 154. The lower gear 832 may move along a track 834 that is coupled to and/or parallel with the lifting base 150.

Figure 9:
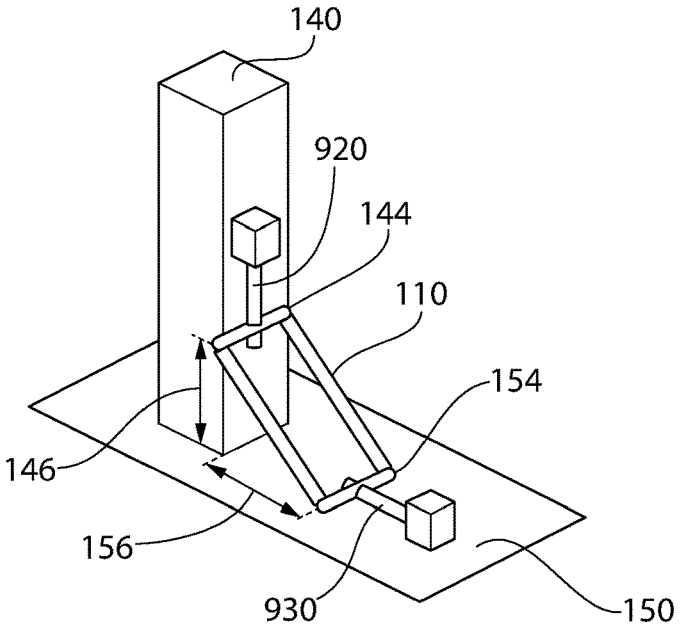
FIG. 9 illustrates a perspective, schematic view of another system for raising the mast including power screws in place of the secondary cylinders, according to an embodiment.

FIG. 9 illustrates a perspective, schematic view of another system 900 for raising the mast 140, according to an embodiment. The system 900 may be similar to the system 100, except that the first and second actuators may be or include upper and lower power screws 920, 930. The upper power screw 920 may be configured to move the mast coupling location 144 toward the pivot point 142 as the mast 140 is being raised, thereby reducing the length 146 between the pivot point 142 and the mast coupling location 144. Similarly, the lower power screw 930 may be configured to move the lifting base coupling location 154 toward the pivot point 142 as the mast 140 is being raised, thereby reducing the length 156 between the pivot point 142 and the lifting base coupling location 154.

Figure 10:
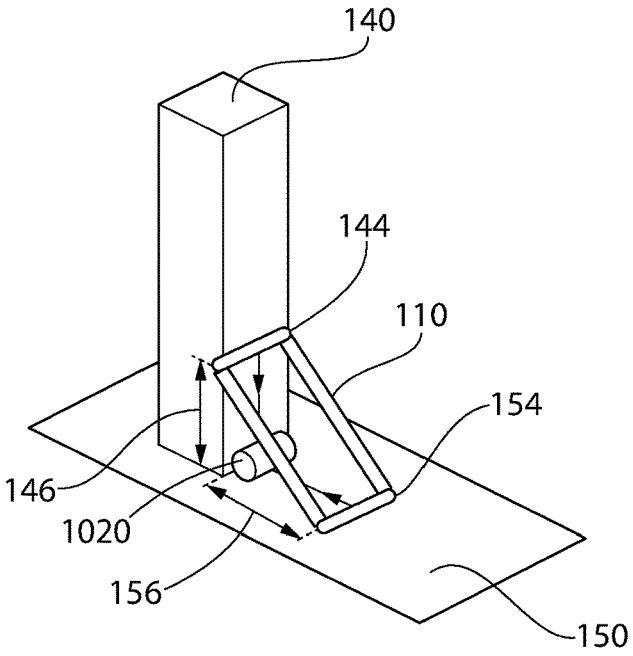
FIG. 10 illustrates a perspective, schematic view of another system for raising the mast including a hoist in place of the secondary cylinders, according to an embodiment.

FIG. 10 illustrates a perspective, schematic view of another system 1000 for raising the mast 140, according to an embodiment. The system 1000 may be similar to the system 100, except that the actuators may be or include a hoist 1020. The hoist 1020 may be coupled to the mast 140 and/or the lifting base 150. The hoist 1020 may be positioned proximate to the pivot point 142. For example, the hoist 1020 may be positioned between the mast coupling location 144 and a base of the mast 140 and/or between the lifting base coupling location 154 and the base of the mast 140. The hoist 1020 may be configured to pull the mast coupling location 144 toward the pivot point 142 as the mast 140 is being raised, thereby reducing the length 146 between the pivot point 142 and the mast coupling location 144. Similarly, the hoist 1020 may be configured to pull the lifting base coupling location 154 toward the pivot point 142 as the mast 140 is being raised, thereby reducing the length 156 between the pivot point 142 and the lifting base coupling location 154.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A system for raising a mast, comprising:

a primary cylinder having a first end configured to be coupled to the mast and a second end configured to be coupled to a lifting base, wherein the primary cylinder is configured to actuate from a retracted position to an extended position to at least partially raise the mast;

an actuator configured to actuate from a retracted position to an extended position to at least partially raise the mast, thereby moving the first end of the primary cylinder or the second end of the primary cylinder toward a pivot point between the mast and the lifting base, wherein the actuator comprises an upper secondary cylinder, wherein a first end of the upper secondary cylinder is configured to be coupled to the mast at a fixed location, and wherein a second end of the upper secondary cylinder moves toward the pivot point when the upper secondary cylinder actuates from the retracted position to the extended position, thereby moving the first end of the primary cylinder toward the pivot point; and a lower secondary cylinder, wherein a first end of the lower secondary cylinder is configured to be coupled to the lifting base at a fixed location, and wherein a second end of the lower secondary cylinder moves toward the pivot point when the lower secondary cylinder actuates from the retracted position to the extended position, thereby moving the second end of the primary cylinder toward the pivot point.

2. The system of claim 1, wherein the primary cylinder is configured to actuate before the actuator.

3. The system of claim 1 wherein the primary cylinder actuates before the upper secondary cylinder and the lower secondary cylinder, and wherein the upper secondary cylinder and the lower secondary cylinder actuate simultaneously.

4. The system of claim 3, wherein a force on the primary cylinder decreases between a first time when the primary cylinder begins actuating and a second time when the upper secondary cylinder begins actuating, and wherein the force on the primary cylinder increases and then subsequently decreases between the second time and a third time when the primary cylinder, the upper secondary cylinder, or both are in the extended position.

5. The system of claim 3, wherein a maximum force on the upper secondary cylinder when the upper secondary cylinder actuates is less than half of a maximum force on the primary cylinder when the primary cylinder actuates.

6. The system of claim 1, wherein the actuator comprises a motor, a gearbox, a wheel, or a combination thereof, and wherein at least a portion of the actuator moves toward the pivot point when the actuator actuates from the retracted position to the extended position, thereby moving the first end of the primary cylinder or the second end of the primary cylinder toward the pivot point.

7. The system of claim 1, wherein the actuator comprises a power screw, and wherein at least a portion of the actuator moves toward the pivot point when the actuator actuates from the retracted position to the extended position, thereby moving the first end of the primary cylinder or the second end of the primary cylinder toward the pivot point.

8. The system of claim 1, wherein the actuator comprises a hoist that pulls the first end of the primary cylinder, the second end of the primary cylinder, or both ends of the primary cylinder toward the pivot point.

9. A system for raising a mast, comprising:

first and second primary cylinders that are substantially parallel to one another, the first and second primary cylinders each having a first end configured to be coupled to the mast and a second end configured to be coupled to a lifting base, wherein the first and second primary cylinders each actuate from a retracted position to an extended position;

first and second upper secondary cylinders that are substantially parallel to one another, the first and second upper secondary cylinders each having a first end that is in a fixed position with respect to the mast and a second end that is configured to push the first ends of the first and second primary cylinders, respectively, toward a pivot point between the mast and the lifting base when the first and second upper secondary cylinders actuate from a retracted position to an extended position; and first and second lower secondary cylinders that are substantially parallel to one another, the first and second lower secondary cylinders each having a first end that is in a fixed position with respect to the lifting base and a second end that is configured to push the second ends of the first and second primary cylinders, respectively, toward the pivot point when the first and second lower secondary cylinders actuate from a retracted position to an extended position.

10. The system of claim 9, wherein the first primary cylinder actuates simultaneously or alternatively with respect to the first upper secondary cylinder, the first lower secondary cylinder, or both.

11. The system of claim 9, wherein the first upper secondary cylinder actuates sequentially, simultaneously, or alternatively with respect to the first lower secondary cylinder.

12. The system of claim 11, wherein a force on the first and second primary cylinders decreases between a first time when the first and second primary cylinders begin actuating and a second time when the first and second upper secondary cylinders begin actuating, and wherein the force on the first and second primary cylinders increases and then subsequently decreases between the second time and a third time when the first and second primary cylinders are in the extended position.

13. The system of claim 12, wherein a maximum force on the first and second upper secondary cylinders when the first and second upper secondary cylinders actuate is less than half of a maximum force on the first and second primary cylinders when the first and second primary cylinder actuate.

14. A method for raising a mast, comprising:

actuating a primary cylinder from a first position to a second position to at least partially raise the mast, wherein the primary cylinder comprises a first end coupled to the mast and a second end coupled to a lifting base;

actuating an actuator from a first position to a second position, which causes the first end of the primary cylinder or the second end of the primary cylinder to move toward a pivot point between the mast and the lifting base, wherein the actuator comprises an upper secondary cylinder, wherein a first end of the upper secondary cylinder is coupled to the mast at a fixed location, and wherein a second end of the upper secondary cylinder moves toward the pivot point when the upper secondary cylinder actuates from the first position to the second position, thereby moving the first end of the primary cylinder toward the pivot point; and actuating a lower secondary cylinder from a first position to a second position, wherein a first end of the lower secondary cylinder is coupled to the lifting base at a fixed location, and wherein a second end of the lower secondary cylinder moves toward the pivot point when the lower secondary cylinder actuates from the first position to the second position, thereby moving the second end of the primary cylinder toward the pivot point.

15. The method of claim 14, wherein the primary cylinder actuates before the upper secondary cylinder and the lower secondary cylinder, and wherein the upper secondary cylinder and the lower secondary cylinder actuate simultaneously.

16. The method of claim 14, wherein the primary cylinder comprises a one-stage cylinder or a multi-stage cylinder.

* * * * *